United States Patent [19]

Crawford

[11] Patent Number: 4,773,538

[45] Date of Patent: Sep. 27, 1988

[54] CONTAINER FOR GARMENTS SUSPENDED ON HANGERS AND BLANK THEREFOR

[76] Inventor: Darwin L. Crawford, 1215 Reid St., Newberry, S.C. 29108

[21] Appl. No.: 74,664

[22] Filed: Jul. 17, 1987

[51] Int. Cl.[4] ..... B65D 85/18

[52] U.S. Cl. ..... 206/289; 206/279; 229/122; 229/127; 312/259

[58] Field of Search ..... 206/278, 279, 284, 289, 206/290, 291, 299; 312/259; 229/122, 127, 155–157

[56] References Cited

U.S. PATENT DOCUMENTS

| | | | |
|---|---|---|---|
| 2,561,053 | 7/1951 | Fallert | 206/291 |
| 2,648,480 | 8/1953 | Belsinger | 229/122 |
| 2,770,357 | 11/1956 | Sheard | 312/259 X |
| 3,226,007 | 12/1965 | Thres et al. | 229/127 |
| 3,262,631 | 7/1966 | Belsinger | 206/299 X |
| 3,294,221 | 12/1966 | Notko et al. | 206/289 |
| 3,371,845 | 3/1968 | Frieman | 229/127 X |
| 3,565,242 | 2/1971 | Konkoli | 206/290 |

*Primary Examiner*—Stephen Marcus
*Assistant Examiner*—Bryon Gehman
*Attorney, Agent, or Firm*—Thomas A. Meehan; John R. Nelson

[57] ABSTRACT

A front loading corrugated container for the storage or shipment of garments on hangers. The container is erected from a unitary blank and has a four-sided tubular body which is closed at the top by a closure that is formed from flaps that are foldably attached to the tops of the sides of the body. Each of an opposed pair of top flaps has a secondary flap which is inturned with respect to the top flap to which it is attached to extend into the interior of the container through aligned slots in another of an opposed pair of top flaps, and the secondary flaps, which constitute an integral hanger bar, have aligned apertures for receiving garment hanger hooks and are supported along opposed sides by portions of each of the other opposed pair of top flaps which lie on the opposed sides of the slots therein. The side of the body that has one of the other opposed pair of top flaps has a top portion which is separated from adjacent sides of the container by slots to permit the top portion to be folded between a closing position and an open position, and to thereby serve as a drop panel for access into the interior of the container. The bottom of the container is closed by a conventional closure that is formed from flaps which are foldably attached to the bottom of the sides of the body.

20 Claims, 2 Drawing Sheets

CONTAINER FOR GARMENTS SUSPENDED ON HANGERS AND BLANK THEREFOR

BACKGROUND OF THE INVENTION

1. Field of the Invention

This invnetion relates to a container for the shipment and/or storage of garments on hangers and to a unitary blank of a foldable sheetlike material from which such a container can be erected.

2. Description of the Prior Art

It is known in the prior art to provide special corrugated fiberboard containers for the shipment and/or storage of garments on hangers to ensure that the garments do not become unduly wrinkled during shipment or storage. U.S. Pat. No. 3,360,113 (T. E. Bower), which is assigned to the assignee in this application, discloses a garment container of the foregoing character. Other prior art garment containers which are erected from blanks of a foldable sheetlike material are disclosed in U.S. Pat. Nos. 2,561,053 (C. D. Fallert), 2,817,431 (H. F. Cecil), 2,873,851 (H. J. Abramson), 3,139,978 (J. A. Moglia), 3,565,242 (E. Kenkell), 3,866,750 (H. S. Collin), 4,119,197 (W. M. Pilz), 4,151,947 (J. H. Partain), 4,060,169 (L. R. Hildebrand, et. al.), 4,416,371 (J. F. Nauheimer), and 4,324,389 (B. R. Bethune, et al.).

As is clear from the foregoing prior art references, the problems addressed by prior inventors of corrugated fiberboard garment containers have chiefly focused on the provision of a transversely extendingly bar of suitable strength and rigidity to carry the weight of several hangers with garments thereon, and on the provision of a suitable foldable entry panel for access to the interior of the container as required for the placement of garments on hangers in the container and for the removal of garments on hangers therefrom.

With respect to the problem of providing a transversely extending bar of suitable strength and rigidity, prior artisans usually have either utilized a separate, reinforced member, as is typified by aforesaid U.S. Pat. Nos. 3,360,113 and 3,866,750, or they have attempted to form an integral hanger bar from the elements of the container blank itself, as is typified by the aforesaid U.S. Pat. Nos. 4,060,169 and 4,342,389. However, the use of a separate hanger bar, especially a reinforced hanger bar, adds to the expense of the container, and the use of an integral hanger bar requires a rather complex construction to provide suitable hanger bar rigidity, especially considering the weight of multiple garments on hangers which are to be suspended therefrom, and the fact that the container blank itself must be relatively thin and lightweight to permit it to be folded into the container in question. Further, the problem of providing a suitable foldable entry panel has been addressed as a separate problem, for example, as is shown in the aforesaid U.S. Pat. Nos. 2,561,053, 3,139,978 and 4,342,389, without attempting to utilize the entry panel to support the opposed sides of an integral hanger bar.

SUMMARY OF THE INVENTION

According to the present invention there is provided a container for garments on hangers which is formed from a die-cut blank of a suitable foldable sheetlike material, for example, corrugated fiberboard, and a unitary blank from which such a container is formed. The container of the present invention is adapted to suspend the garments on hangers from a hanger bar that is formed integrally in a closure which includes flaps at the top of the container, and the container includes a foldable drop panel for access to the garments on hangers. The drop panel has a flap which underlies the closure flaps at the top of the container when the drop panel is in its closing position, and the flap has a slot therein to permit it to be inserted into the container on opposed sides of the integral hanger bar. Thus, the drop panel flap supports the hanger bar along its opposed sides, and this support permits the simplification of the hanger bar and, consequently, a reduction in the cost of the container. Further, a drop panel provides for ready access to the interior of the container for the convenient insertion of garments on hangers therein and for the convenient removal of the garments on the hangers.

Accordingly, it is an object of the present invention to provide an improved container for garments on hangers, and it is a corollary object to provide a die-cut blank of a foldable, sheetlike material from which such a container can be erected. More particularly, it is an object of the present invention to provide a container for garments on hangers with a hanger bar that is formed integrally with the container and with an integral foldable drop panel which reinforces the hanger bar when the drop panel is in a first, closing position and which provides for ready access into the interior of the container when the drop panel is in a second, open position, and it is a corollary object of the present invention to provide a die-cut blank of a foldable sheetlike material from which such a container can be erected. For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 2:
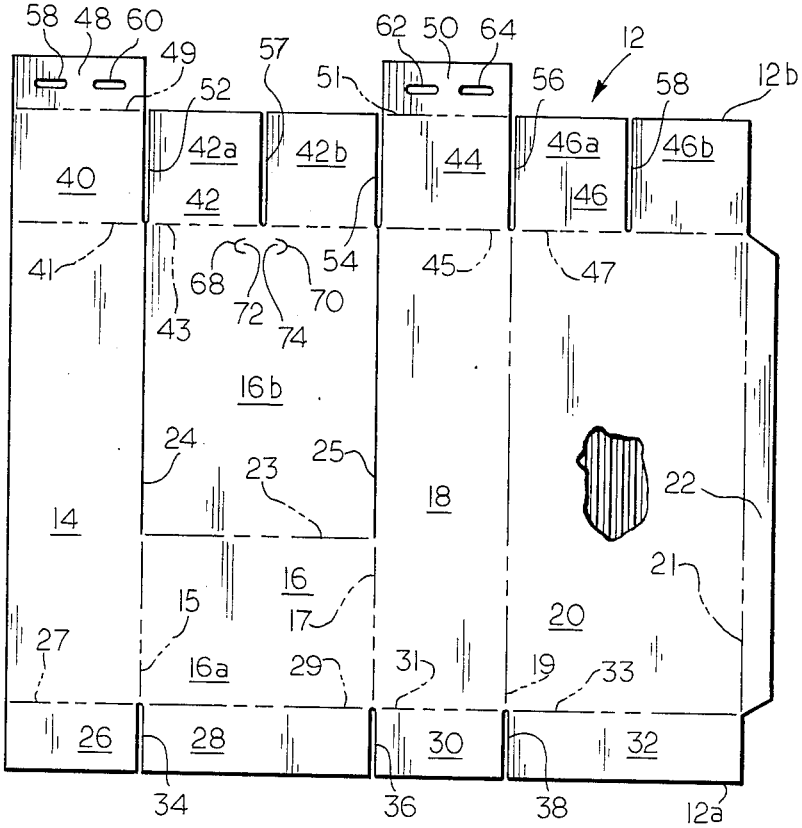
FIG. 2 is a plan view of a die-cut blank of a foldable sheetlike material from which the container of FIG. 1 can be erected.
Figure 1:
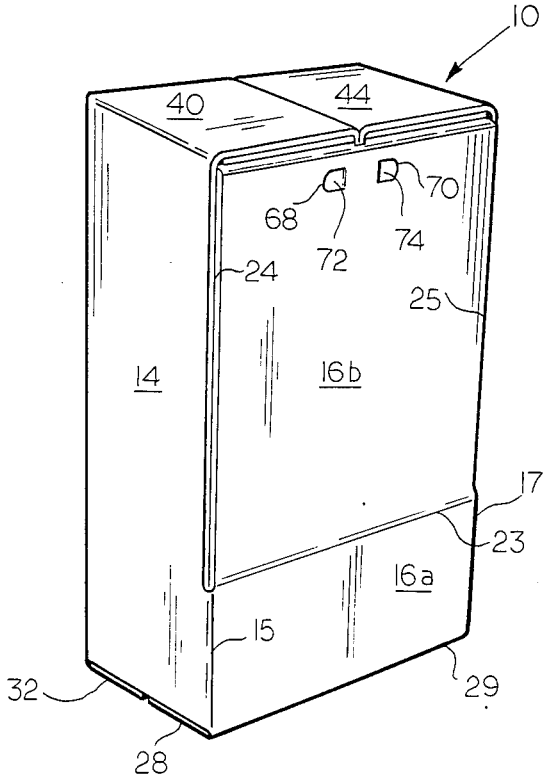
FIG. 1 is a perspective view of a garment container according to the preferred embodiment of the present invention in the fully erected and closed condition of such container.

As is shown in FIG. 1, a blank according to the present invention is identified generally by reference numeral 12 and is formed by die-cutting a foldable sheetlike material, preferably corrugated fiberboard. The blank 12 includes serially connected, and generally rectangularly shaped panels 14, 16, 18 and 20. The panels 14 and 16 are foldably attached to each other along a fold line 15; the panels 16 and 18 are foldably attached to each other along a fold line 17; and the panels 18 and 20 are foldably attached to each other along a fold line 19. The fold lines 15, 17 and 19 are formed by scoring the blank 12 or they may be formed by slit scoring. The blank 12 also includes a flap 22 which is foldably attached to the panel 20 along a fold line 21. The fold line 21, like the fold lines 15, 17 and 19, is also formed by scoring or slit scoring.

The fold lines 19 and 21 extend for the full height of the panel 20 and the fold lines 15 and 17 extend from the bottom of the panel 16 partially to the top thereof. A transversely extending fold line 23 extends between the ends of the fold lines 15 and 17 and is also formed by scoring or slit scoring. Thus, the fold line 23 subdivides the panel 16 into a lower portion 16*a* below the fold line 23 and an upper portion 16*b* above the fold line 23. The upper portion 16*b* of the panel 16 is separated from the adjacent portions of the panels 14 and 18 by cuts or slots 24 and 25, respectively, which are aligned with fold lines 15 and 17, respectively.

Figure 3:
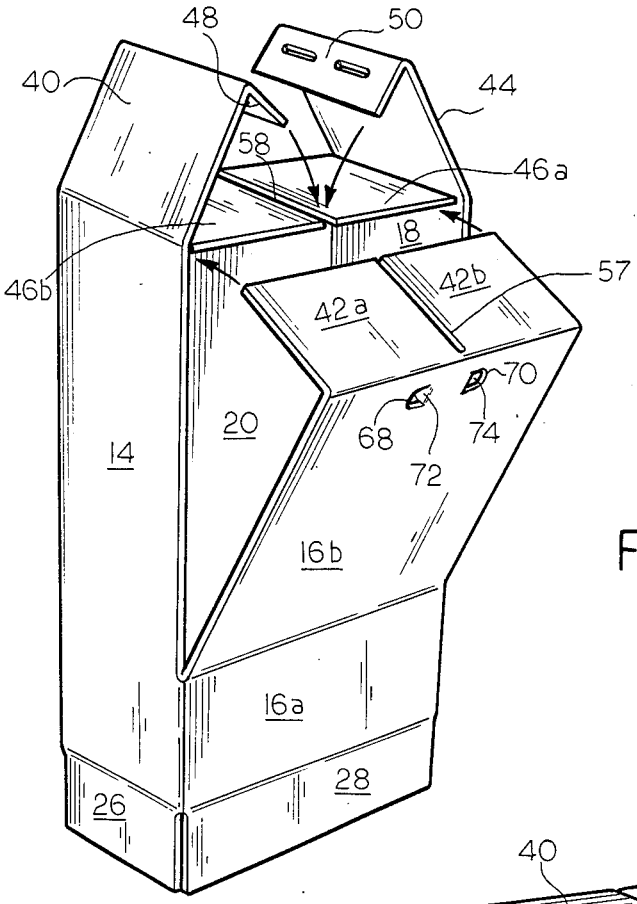
FIG. 3 is a perspective view illustrating a stage in the erection of the container of FIG. 1 from the blank of FIG. 2.
Figure 4:
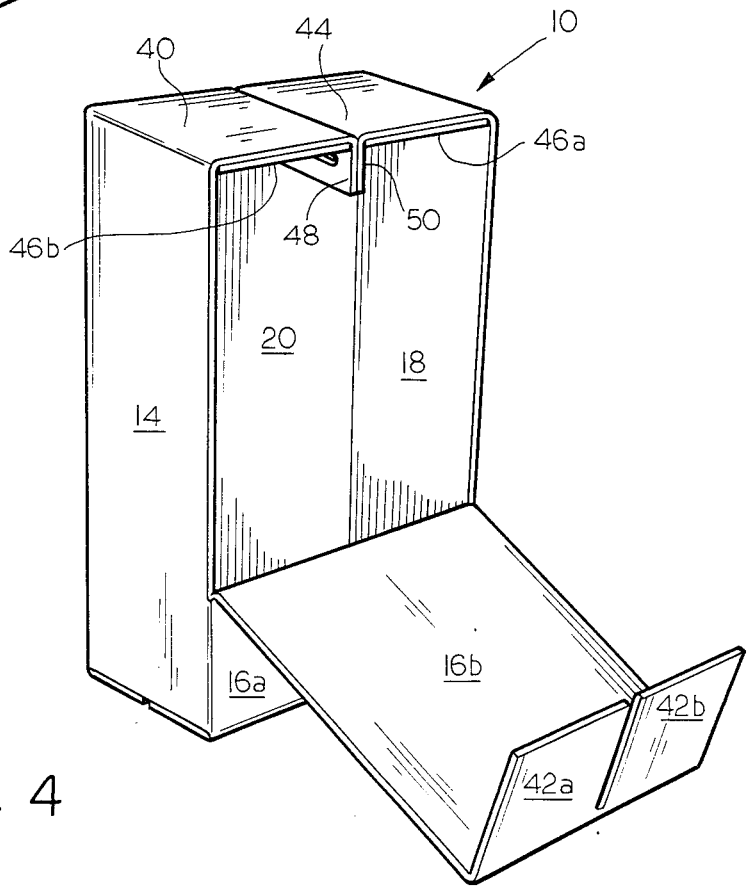
FIG. 4 is a perspective view of the container of FIG. 1 in the fully erected, opened condition of such container.

As is shown in FIGS. 1, 3 and 4, the forming of a container, identified by reference numeral 10, from the blank 12 involves folding the blank 12 along the fold lines 15, 17, 19 and 21 into a tubular configuration to bring the flap 22 into juxtaposition with the panel 14. Thus, in this tubular configuration the panels 14 and 18 constitute a first set of opposed, spaced apart walls which extend parallel to one another, and the panels 16 and 20 constitute a second set of opposed, spaced apart walls. Then, the flap 22 and the panel 14 are then secured together by stapling, by an adhesive or by other known means for forming a joint in a container. The portion of the container 10 which is the bottom thereof when the container is in an upright position, as is illustrated in FIG. 1, is formed by a series of flaps 26, 28, 30 and 32 which are foldably attached to panels 14, 16, 18 and 20, respectively, along aligned fold lines 27, 29, 31 and 33. The fold lines 27, 29, 31 and 33 are also formed by scoring or slit scoring. The flaps 26 and 28 are separated from one another by a slot 34 which extends from the adjacent bottom edge 12*a* of the blank 12 to or substantially to the juncture of the aligned fold lines 27 and 29; the flaps 28 and 30 are separated from another by a slot 36 which extends from the adjacent bottom edge 12*a* of the blank 12 to or substantially to the juncture between the aligned fold lines 29 and 31; and the flaps 30 and 32 are separated from one another by a slot 38 which extends from the adjacent bottom edge 12*a* of the blank 12 to or substantially to the juncture between the aligned fold lines 31 and 33. Thus, a closed bottom for the container 10 is formed by folding the flaps 26 and 30 to extend inwardly and perpendicularly from the panels 14 and 18, respectively, by folding the flaps 28 and 32 to extend inwardly and perpendicularly from the panels 16 and 18, respectively, and by adhesively bonding, stapling or otherwise securing the flaps 28 and 32 to underlying portions of each of the flaps 26 and 30.

The top structure and integral hanger bar of the container 10 is formed by a series of flaps, 40, 42, 44 and 46, which are foldably attached to panels 14, 16, 18 and 20, respectively, along aligned fold lines 41, 43, 45 and 47, which are formed by scoring or slit scoring, and by secondary flaps 48 and 50 which are foldably attached to the flaps 40 and 44, respectively, along aligned fold lines 49 and 51, which are also formed by scoring or slit scoring. The flaps 40 and 42 are separated from one another by a slot 52 which extends from the adjacent top edge 12*b* of the blank 12 to or substantially to the juncture of the aligned fold lines 41 and 43; the flaps 42 and 44 are separated from one another by a slot 54 which extends from the adjacent top edge 12*b* of the blank 12 to or substantially to the juncture between the aligned fold lines 43 and 45; and the flaps 44 and 46 are separated from one another by a slot 56 which extends from the edge of the blank 12 to or substantially to the juncture of the aligned fold lines 45 and 47. Further, the flap 42 is subdivided into a left hand portion 42*a* and a right hand portion 42*b* by a slot 57 which extends from the adjacent top edge 12*b* of the blank 12 to or substantially to the fold line 43, and which is positioned evenly between the slots 52 and 54; and the flap 46 is subdivided into a left hand portion 46*a* and a right hand portion 46*b* by a slot 58 which extends from the adjacent top edge 12*b* of the blank 12 to or substantially to the fold line 17, and which is positioned midway between the edges of the flap 46.

As is shown most clearly in FIG. 3, the assembly of the top structure of the container 10 from the blank 12 is accomplished by folding the panel 46 to extend inwardly and perpendicularly from the panel 20, by folding the secondary flaps 48 and 50 to extend inwardly and perpendicularly from the flaps 40 and 44, respectively, by folding the flaps 40 and 44 inwardly and perpendicularly from the panels 14 and 18, respectively, an act which results in the positioning of the secondary flap 48 and 50 within the slot 58 of the flap 46, by folding the flap 42 to extend inwardly and perpendicularly from the upper portion 16*b* of the panel 16, and by folding the upper portion 16*b* of the panel 16 to be in alignment with the lower portion 16*a* of the panel 16, which will result in the passage of the secondary flaps 48 and 52 into the slot 57, as the flap 42 enters into the interior of the container 10, preferably, at an elevation beneath that of the flap 46. The secondary flaps 48 and 50, which are in juxtaposition in the assembled container 10, as is illustrated in FIG. 4, are provided with aligned slots, including the slots 58 and 60 in the secondary flap 48 and the slots 62 and 64 in the secondary flap 50, and the slots 58, 60, 62 and 64 are adapted to receive the hook portions of garment hangers to suspend the garment hangers and the garments on the hangers from an integral hanger bar which includes the secondary flaps 48 and 50. The width of each of the slots 57 and 58 is not appreciably greater that the combined thickness of the secondary flaps 48 and 50 which are inserted thereinto, and such width is preferably approximately equal to such combined thickness; thus, the integral hanger bar that is made up of the secondary flaps 48 and 50 is supported along the entirety of its length on both sides by the left hand portion 46*a* and the right hand portion 46*b* of the flap 46 when the container 10 is in its FIG. 4, opened condition, and it is further supported along the entirety of its length along both, opposed sides thereof by the left hand portion 42*a* and the right hand portion 42*b* of the flap 42 when the container 10 is in its FIG. 1, closed condition. To facilitate the opening of the container 10, the upper portion 16*b* of the panel 16 is provided with opposed, double-ended cuts 68 and 70 which define inwardly deflectable tabs 72 and 74, respectively, and which, thus, define finger receiving apertures.

For convenient access into the interior of the container 10, the upper portion 16*b* of the panel 16 may be folded outwardly with respect to the lower portion 16*a*, by folding it in along the fold line 23, to change its position from the position illustrated in FIG. 1 to that illustrated in FIG. 4.

The best mode known to me to carry out this invention has been described above in terms sufficiently full, clear, concise and exact as to enable any persons skilled in the art to make and use the same. It is to be understood however, that it is within my contemplation that certain modifications of the above-described mode of practicing the invention can be made by a skilled artisan without departing from the scope of the invention and it is, therefore, desired to limit the invention only in accordance with the appended claims.

I claim:

1. A container for garments suspended on hangers, said container having a top, a bottom and an interior and being formed from a generally rectangular planar blank of a foldable sheetlike material, said blank having a top edge and a bottom edge, said container comprising:

four sides formed in an open-ended tubular configuration from four serially connected panels in said blank by bending along fold lines at the junctures between said panels, said four sides including a first pair of opposed, spaced apart sides that extend generally parallel to one another and a second pair of opposed, spaced apart sides that extend generally parallel to one another and generally transversely of said first pair of opposed, spaced apart sides;

at least a pair of top flaps, said at least a pair of top flaps comprising a first top flap which is formed in said blank and which is foldable with respect to one of said first pair of opposed, spaced apart sides along a fold line at a juncture between said first top flap and said one of said first pair of opposed, spaced apart sides at said top of said container to extend generally normally from said one of said first pair of opposed, spaced apart sides toward the other of said first pair of opposed spaced apart sides, said at least a pair of top flaps further comprising a second top flap which is formed in said blank and which is folded with respect to one of said second pair of opposed, spaced apart sides along a fold line at a juncture between said second top flap and said one of said second pair of opposed spaced apart sides at said top of said container to extend generally normally from said one of said second pair of opposed, spaced apart sides toward the other of said second pair of opposed, spaced apart sides, said first top flap having a first portion and a second portion and a slot separating said first portion from said second portion, said slot extending generally perpendicularly from said top edge of said blank to said fold line at said juncture between said first top flap and said one of said first pair of opposed, spaced apart sides, said second top flap further having an edge which is spaced from and which extends generally parallel to said fold line at said juncture between said second top flap and said one of said second pair of opposed, spaced apart sides;

a secondary flap, said secondary flap being formed in said blank and being foldably attached to said second top flap at said edge of said second top flap, said secondary flap further having aperture means therein for receiving and suspending at least one garment hanger, said secondary flap being folded with respect to said second top flap to extend through said slot in said first top flap into said interior of said container;

means closing said bottom of said container;

fold line means in the other of said first pair of opposed, spaced apart sides, said fold line means extending transversely of said container and separating said other of said first pair of opposed, spaced apart sides into a top portion and a bottom portion; and slot means separating said top portion of said other of said first pair of opposed, spaced apart sides from each of said second pair of opposed, spaced apart sides, said slot means permitting said top portion of said other of said first pair of opposed, spaced apart sides to be folded about said fold line means between a closing position and an open position to selectively open or close said interior of said container for the insertion of garments on hangers into said container and the removal of garments on hangers from said container.

2. A container according to claim 1 wherein said foldable sheetlike material is corrugated fiberboard.

3. A container according to claim 1 and further comprising:

a third top flap which is formed in said blank and which is folded with respect to the other of said second pair of opposed, spaced apart sides along a fold line at a juncture between said third top flap and the top of said other of said second pair of opposed, spaced apart sides to extend generally normally from said other of said second pair of opposed, spaced apart sides toward said one of said second pair of opposed, spaced apart sides, said third top flap having an edge which is spaced from and which extends generally parallel to said fold line at said juncture between said third top flap and said other of said second pair of opposed, spaced apart sides; and a second secondary flap having opposed sides, said second secondary flap being formed in said blank and being foldably attached to said third top flap at said edge of said third top flap, said second secondary flap being folded with respect to said third top flap to extend through said slot in said first top flap into said interior of said container, said second secondary flap being disposed adjacent to said secondary flap and having second aperture means therein in alignment with said aperture means of said secondary flap.

4. A container according to claim 3 wherein said foldable sheetlike material is corrugated fiberboard.

5. A container according to claim 4 wherein said secondary flap has a first thickness, wherein said second secondary flap has a second thickness, wherein said slot has a width, and wherein said width is not appreciably greater that said first thickness plus said second thickness, whereby said first top flap supports said secondary flap and said second secondary flap within said container.

6. A container according to claim 3 and further comprising:

a fourth top flap which is formed in said blank and which is folded with respect to said other of said first pair of opposed sides along a fold line at a juncture between said fourth top flap and said other of said first pair of opposed sides at said top of said container, said fourth top flap having a first portion and a second portion and a slot separating said first portion from said second portion, said slot of said fourth top flap extending generally perpendicularly from said top edge of said blank to said fold line at said juncture between said fourth top flap and said other of said first pair of opposed, spaced apart sides, said secondary flap and said second secondary flap extending through said slot of said fourth top flap when said top portion of said other of said first pair of opposed, spaced apart sides is in said closing position.

7. A container according to claim 6 wherein said foldable sheetlike material is corrugated fiberboard.

8. A container according to claim 7 wherein said secondary flap has a first thickness, wherein said second secondary flap has a second thickness, wherein said slot of said first top flap has a width, wherein said slot of said fourth top flap has a second width, and wherein each of said width and said second width is not appreciably greater than said first thickness plus said second thickness, whereby said first top flap supports said secondary flap and said second secondary flap within said container and said fourth top flap supports said secondary flap and said second secondary within said container when said top portion of said other of said first pair of opposed, spaced apart sides is in said closing position.

9. A container according to claim 8 and further comprising:

tab means in said top portion of said other of said first pair of opposed, spaced apart sides for facilitating the folding of said other of said first pair of opposed, spaced apart sides from said closing position to said open position.

10. A container according to claim 8 wherein said first top flap is positioned above said fourth top flap.

11. A container according to claim 8 wherein each of said first top flap and said fourth top flap supports said secondary flap within said container when said top portion of said other of said first pair of opposed, spaced apart sides is in said closing position substantially along the entirety of the length of said secondary flap and said second secondary flap.

12. A generally rectangular unitary blank of a foldable sheetlike material which is adapted to be formed into a container for garments suspended on hangers, said blank having a top edge and comprising;

four serially connected and generally rectangularly shaped panels, said panels being separted by fold lines at the junctures between said panels and being adapted to be folded at said fold lines into an open-ended tubular configuration which has four sides including a first pair of opposed, spaced apart sides that extend generally parallel to one another and a second pair of opposed, spaced aparts sides that extend generally parallel to one another and generally transversely of said first pair of opposed, spaced apart sides, each of said panels being adapted to form one of said four sides of said open-ended tubular configuration;

at least a pair of top flaps, said at least a pair of top flaps comprising a first top flap which is foldably attached to one of said panels that is adapted to form one of said first pair of opposed, spaced apart sides along a fold line at a juncture between said first top flap and said one of said panels to be adapted to extend generally normally from said one of said panels toward a second of said panels that is adapted to form the other of said first pair of opposed, spaced apart sides, said at least a pair of top flaps further comprising a second top flap which is foldably attached to a third of said panels which is adapted to form one of said second pair of opposed, spaced apart sides along a fold line at a juncture between said second top flap and said third of said panels to be adapted to extend generally normally from said third of said panels toward a fourth of said panels which is adapted to form the other of said second pair of opposed, spaced apart sides, said first top flap having a first portion and a second portion and a slot separating said first portion from said second portion, said slot extending generally perpendicularly from said top edge of said blank to said line at said juncture between said first top flap and said one of said panels, said second top flap further having an edge which is spaced from said top of said blank and which extends generally parallel to said fold line at said juncture between said second flap and said third of said panels;

a secondary flap, said secondary flap being foldably attached to said second top flap at said edge of said second top flap, said secondary flap being adapted to be folded with respect to said second top flap to be inserted into said container through said slot in said first top flap, said secondary flap having aperture means therein for receiving and suspending at least one garment hanger;

means for closing said bottom of said container;

fold line means in said second of said panels, said fold line means extending transversely of said tubular configuration and separating said second of said panels into a top portion and a bottom portion; and slot means separating said top portion of said second of said panels from adjacent panels of said four serially connected panels, said slot means permitting said top portion of said second of said panels to be folded about said fold line means with respect to said bottom portion of said second of said panels between a closing position and an open position.

13. A blank according to claim 12, wherein said foldable sheetlike material is corrugated fiberboard.

14. A blank according to claim 12 wherein said foldable sheetlike material is corrugated fiberboard.

15. A blank according to claim 14 wherein said secondary flap has a thickness, wherein said slot in said first top flap has a width, and wherein said width is not appreciably greater that said first thickness plus said second thickness.

16. A blank according to claim 12 and further comprising:

a third top flap which is foldably attached to said second of said panels along a fold line at a juncture between said third top flap and said second of said panels to be adapted to extend generally normally from said second of said panels toward said one of said panels, said third top flap having an edge which is spaced from and which extends generally parallel to said fold line at said juncture between said third flap and said second of said panels; and a second secondary flap, said second secondary flap being foldably attached to said third top flap at said edge of said third top flap, said second secondary flap being adapted to be folded with respect to said third top flap to be inserted into said container through said slot in said first top flap, said second secondary flap being adapted to be adjacent to said secondary flap when said secondary flap and said second secondary flap are inserted into said container and having a second aperture means which are adapted to be in alignment with said aperture means in said secondary flap.

17. A blank according to claim 16 and further comprising:

a fourth top flap which is foldably attached to said second of said panels along a fold line at a juncture between said fourth top flap and said second of said panels, said fourth top flap having a first portion and a second portion and a slot separating said first portion from said second portion, said slot of said fourth top flap extending generally perpendicularly from said top edge of said blank to said fold line at said juncture between said fourth top flap and said second of said panels, said secondary flap and said second secondary flap being adapted to be inserted into said container through said slot in said second of said panels when said top portion of said second of said panels is in said closing position.

18. A blank according to claim 17 wherein said secondary flap has a first thickness, wherein said second secondary blank has a second thickness, wherein said slot of said fourth top flap has a second width, and wherein each of said width and said second width is not appreciably greater than said first thickness plus said second thickness.

19. A blank according to claim 18 wherein said foldable sheetlike material is corrugated fiberboard.

20. A blank according to claim 19 and further comprising:

tab means in said top portion of said second of said panels for facilitating the folding of said top portion of said second of said panels with respect to said bottom portion of said second of said panels.

* * * * *